US007055582B2

(12) United States Patent
Erisgen

(10) Patent No.: US 7,055,582 B2
(45) Date of Patent: Jun. 6, 2006

(54) REFRIGERATING UNIT HAVING HEAT-EXCHANGER MOUNTING SHROUD

(75) Inventor: Sukru Erisgen, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 195 days.

(21) Appl. No.: 10/271,251

(22) Filed: Oct. 15, 2002

(65) Prior Publication Data

US 2004/0069464 A1 Apr. 15, 2004

(51) Int. Cl.
*F25B 29/00* (2006.01)
*F25D 17/06* (2006.01)

(52) U.S. Cl. ..... 165/122; 165/48.1; 165/67; 62/428

(58) Field of Classification Search ..... 165/121, 165/122, 67, 76, 47, 149, 48.1, 173, 176; 180/68.1, 68.4; 415/173.1, 220, 223, 213.1, 415/214.1; 62/77, 298, 428, 262, 263; 403/345, 403/359.5; 123/41.49; 248/233
See application file for complete search history.

(56) References Cited

U.S. PATENT DOCUMENTS

| | | | | | |
|---|---|---|---|---|---|
| 3,795,274 | A * | 3/1974 | Fieni | 165/67 |
| 3,906,741 | A * | 9/1975 | Terry | 62/262 |
| 4,102,148 | A | 7/1978 | Matthews et al. | 62/77 |
| 4,137,982 | A * | 2/1979 | Crews et al. | 180/68.4 |
| 4,403,648 | A * | 9/1983 | Styrok | 165/76 |
| 4,774,911 | A * | 10/1988 | Yamaguchi et al. | 123/41.49 |
| 4,800,735 | A * | 1/1989 | Lang et al. | 62/298 |
| 4,936,381 | A | 6/1990 | Alley | 165/176 |
| 5,015,900 | A * | 5/1991 | Morrill | 310/91 |
| 5,183,103 | A | 2/1993 | Tokutake | 165/167 |
| 5,320,165 | A | 6/1994 | Hughes | 165/153 |
| 5,372,188 | A | 12/1994 | Dudley et al. | 165/110 |
| 5,476,138 | A * | 12/1995 | Iwasaki et al. | 180/68.4 |
| 5,638,693 | A * | 6/1997 | Baek | 62/262 |
| 5,854,738 | A * | 12/1998 | Bowler | 361/695 |
| 5,947,196 | A | 9/1999 | Halm et al. | 165/173 |
| 6,155,335 | A * | 12/2000 | Acre et al. | 165/41 |
| 6,161,609 | A * | 12/2000 | Ahn | 165/41 |
| 6,182,460 | B1 * | 2/2001 | Hernandez et al. | 62/262 |
| 6,318,450 | B1 | 11/2001 | Acre | 165/67 |
| 6,360,818 | B1 | 3/2002 | Bosch et al. | 165/174 |
| 6,523,507 | B1 * | 2/2003 | Schmitz et al. | 123/41.55 |
| 6,601,640 | B1 * | 8/2003 | Staffa et al. | 165/67 |
| 2001/0004010 | A1 | 6/2001 | Halm | 165/67 |
| 2001/0040026 | A1 | 11/2001 | Halm | 165/153 |

FOREIGN PATENT DOCUMENTS

| | | | |
|---|---|---|---|
| JP | 410212956 A * | 8/1998 | |
| JP | 2002239288 A * | 5/2002 | |

* cited by examiner

*Primary Examiner*—Tho Duong
(74) *Attorney, Agent, or Firm*—Baker & Daniels

(57) ABSTRACT

A refrigerating unit including a base, a heat exchanger, and a shroud attached to the base The heat exchanger may have opposite side edges defined by a pair of substantially cylindrical headers, at least one of the headers having an inlet tube or an outlet tube extending, and a substantially rectangular shroud attached to the base and being provided with notched corners. The shroud has a top surface with at least one elongate boss, and integrally-formed resilient gripping portions which capture the heat exchanger headers. The heat exchanger is mounted to the base through engagement with the shroud, clearance is provided between a shroud notched corner and the inlet or outlet tube, and the boss provides a means for supporting the shroud when placed upside down.

17 Claims, 5 Drawing Sheets

REFRIGERATING UNIT HAVING HEAT-EXCHANGER MOUNTING SHROUD

BACKGROUND OF THE INVENTION

The present invention relates to refrigerating or condensing units of the type commonly utilized in refrigeration appliances, and particularly to means for mounting the heat exchanger or condenser on the base of the refrigerating unit and shrouds for directing airflow through the heat exchanger and improving the efficiency of the heat exchange.

Previous condensing units typically included condensers which were mounted via brackets directly to the base of the condensing or a vertical frame fixed to or formed on the base. These brackets are typically attached to the condenser's headers or heat exchange tubes.

An electric fan is usually provided to pull ambient air through the heat exchanger, the airflow generated by the fan being directed by a shroud which substantially encloses the downstream side of the condenser but is provided with a large round aperture, the edge of which is in close proximity to the radially-outermost edges of the fan blades. The shroud may be made of heavy paper or cardboard, metal, or plastic, and is typically attached to heat exchanger headers or heat exchange tubes using brackets. An example of such a shroud is shown in FIG. 1. Shroud 10 is made of sheet metal or cardboard folded into a four-sided substantially parallelepiped shape having top 12, sides 14 and 16 and rear panel 18. Panel 18 is provided with round aperture 20 in which the blades of a motor-driven fan (not shown) are disposed. Near the free edges of sides 14 are 16, a plurality of holes 22 are provided. Holes 22 accommodate screws (not shown) by which shroud 10 is secured via brackets attached to vertically-extending headers provided on opposite edges of the condenser. Shroud 10 is thus attached to a condenser which is separately fixed to the condensing unit base as described above. Notably, it is also common in the prior art for the above-mentioned motor-driven fan to be attached to panel 18 of shroud 10, thereby necessitating their disassembly should one component need to be replaced, and removal of both the shroud and fan from the condensing unit should the condenser, to which both are attached, need to be replaced.

Refrigerant flows to and from the heat exchanger through inlet and outlet tubes typically located near one end of one or both headers. Some previous shrouds require that holes or notches be provided therein through which the condenser inlet and outlet tubes extend, these holes or notches perhaps being added during the assembly process and being uniquely placed depending on the various locations of the inlet and outlet tubes among different condensers. Further, these holes or notches in the shroud may allow air leakage therethrough, which can compromise heat exchanger performance due to ambient air being recirculated through the shroud, rather than directed through the heat exchanger.

Heat exchangers for condensing units have evolved to a preferred design having a pair of vertically-oriented, cylindrical headers, the ends of which are closed, and between which extend a plurality of flat, horizontal heat exchange tubes within each of which are formed a plurality of microchannels. Refrigerant flows between the headers through the microchannels. The heat exchange tubes extend through, and are in contact with, a plurality of vertically-oriented flat fins. Heat is transferred convectively from the refrigerant flowing through the microchannels to the heat exchange tubes, conductively from the heat exchange tubes to the fins, and convectively from the fins to the ambient air flowing through the heat exchanger. Refrigerant enters and exits the heat exchanger through inlet and outlet tubes which are located near opposite ends of one cylindrical header, or near one end of each header, these locations usually being determined by package and performance considerations. Some previous shrouds require that holes or notches be provided therein through which the condenser inlet and outlet tubes extend, these holes or notches perhaps being added during the assembly process and being uniquely placed depending on the various locations of the inlet and outlet tubes among different condensers. Further, these holes or notches in the shroud may allow air leakage therethrough, which can compromise heat exchanger performance due to ambient air being recirculated through the shroud, rather than directed through the heat exchanger.

Heat exchangers having cylindrical headers are known in the art, and are disclosed in, for example, U.S. Pat. No. 4,936,381 (Alley); U.S. Pat. No. 5,320,165 (Hughes); U.S. Pat. No. 5,372,188 (Dudley et al.); U.S. Pat. No. 6,360,818 (Bosch et al.); and U.S. Pat. No. 5,947,196 (Halm et al.); and in Halm's published U.S. patent applications Ser. Nos. 09/370,405 and 09/759,930.

The cylindrical headers and the flat tubes of the now-preferred condenser designs do not lend themselves well to the above-described means for attachment of the condenser to the condensing unit base, or the shroud to the condenser. Thus, an improved mounting means for condensers having cylindrical headers is desired. It is also desired that such an improved condenser mounting means employ relatively fewer parts and tools, and require less condensing unit assembly time. Further, it would be desirable that the condenser and motor-driven fan be separably removable from the condensing unit, thereby facilitating fast and easy repair of the condensing unit.

Moreover, it is desirable to provide a common shroud which can accommodate condensers having various condenser inlet and outlet tube locations, and which is provided with features which facilitate more efficient techniques for assembly of the condenser and shroud, and of the condensing unit as a whole.

SUMMARY

The present invention provides a fan shroud by which a condenser having cylindrical headers is mounted to the base of a condensing unit. No tools are necessary for affixing the condenser to the shroud, or the shroud to the condensing unit base. Further, the inventive shroud, with or without the condenser it supports, and the motor-driven fan are separately affixed to the condensing unit base. Thus, the fan or the condenser may be removed and replaced without removal of the other, thereby simplifying condensing unit service. Moreover, the condenser may be removed from and installed in the condensing unit while leaving the shroud in place, or the condenser and shroud may be removed and installed as an assembly, without affecting the fan.

In accordance with the present invention, a fan shroud is also provided which has integrally-formed notched corners allowing the condenser's inlet and outlet tubes to extend from any of the four corners of the heat exchanger. Because all four corners are notched, the shroud may be used interchangeably among condensers having differing condenser inlet and outlet tube locations. These integrally-formed notched corners also eliminate the need for providing holes or notches in the shroud during assembly processes, thereby minimizing the possibility of adversely affecting heat exchanger performance due to air recirculation through the shroud.

Like previous shrouds, the inventive shroud may stand freely on its bottommost surfaces or feet during assembly processes without falling over. The inventive shroud is also provided, however, with integrally formed, elongated tabs or bosses extending forward and aft on an upper surface thereof. These bosses impart additional strength to the shroud, but more importantly provide surfaces by which the shroud, or the shroud and condenser assembly, may be placed upside down in a substantially vertical orientation and remain freely standing on an assembly table during the condensing unit assembly processes. Thus, more flexible assembly processes are facilitated by the present invention.

The present invention provides a refrigerating unit including a base, a heat exchanger through which air passes, and an air-directing shroud attached to said base. The heat exchanger is engaged with the shroud and is mounted to the base through the engagement of the heat exchanger and the shroud.

The present invention also provides a condensing unit including a base, a heat exchanger through which air passes, and a substantially rectangular air-directing shroud attached to the base. The heat exchanger has opposite side edges defined by a pair of substantially cylindrical headers, and inlet and outlet tubes. At least one of the headers has an inlet tube or outlet tube extending from a side surface of the header near one end. The shroud is provided with a plurality of notched corners, each notched corner forming a notched corner edge. The shroud also has a top surface which is provided with at least one elongate boss, and a plurality of integrally-formed resilient gripping portions which surround and capture the heat exchanger headers, whereby the heat exchanger and the shroud are engaged. The heat exchanger is mounted to the base through the engagement of the heat exchanger and the shroud, clearance is provided between the shroud notched corner edge and the heat exchanger inlet or outlet tube, and the boss provides a means for supporting the shroud when placed upside down prior to the shroud being attached to the base.

The present invention also provides a refrigerating unit including a base, a heat exchanger, and a shroud attached to the base. The shroud is provided with integrally formed means for gripping the heat exchanger and mounting the heat exchanger to the base.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Figure 1:
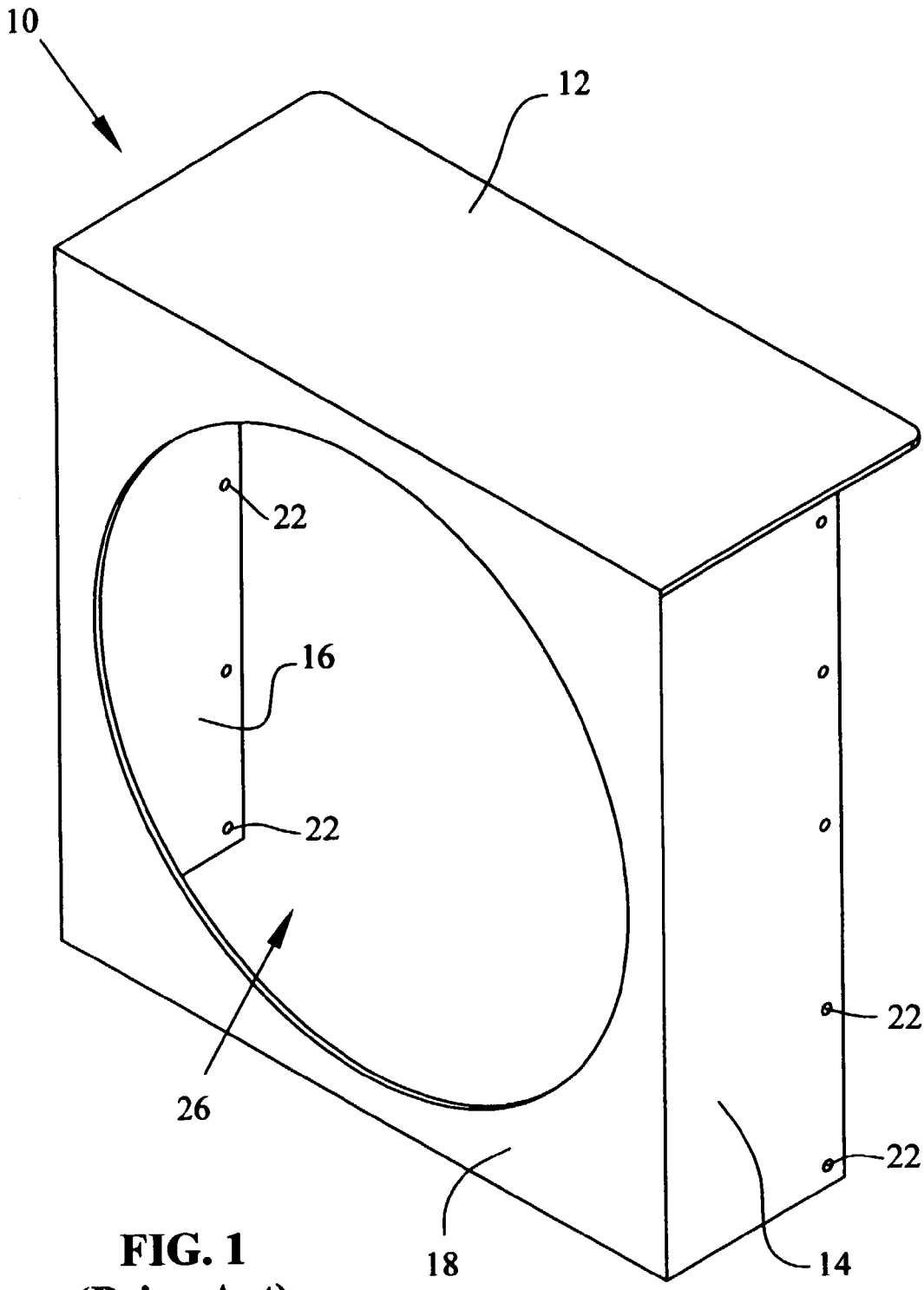
FIG. 1 (Prior Art)
FIG. 1 is a perspective view of a condensing unit fan shroud typically employed in the prior art.

Corresponding reference characters indicate corresponding parts throughout the several views. Although the drawings represent an embodiment of the present invention, the drawings are not necessarily to scale and certain features may be exaggerated or simplified in order to better illustrate and explain the present invention. The exemplification set out herein illustrates an embodiment of the invention in one form, and such exemplification is not to be construed as limiting the scope of the invention in any manner.

DETAILED DESCRIPTION OF THE INVENTION

Figure 2:
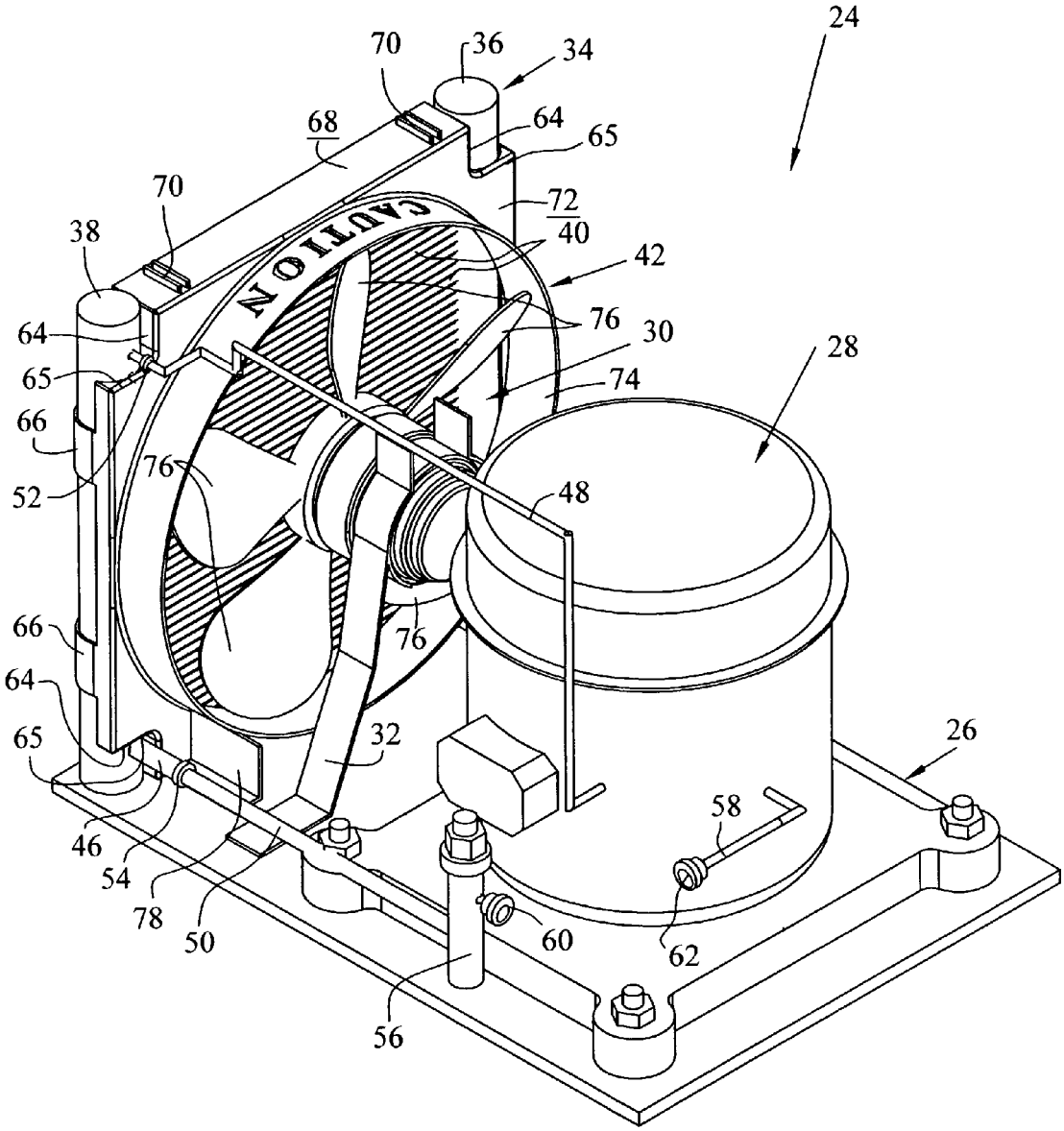
FIG. 2 is a perspective view of a condensing unit including a fan shroud in accordance with the present invention.
Figure 3:
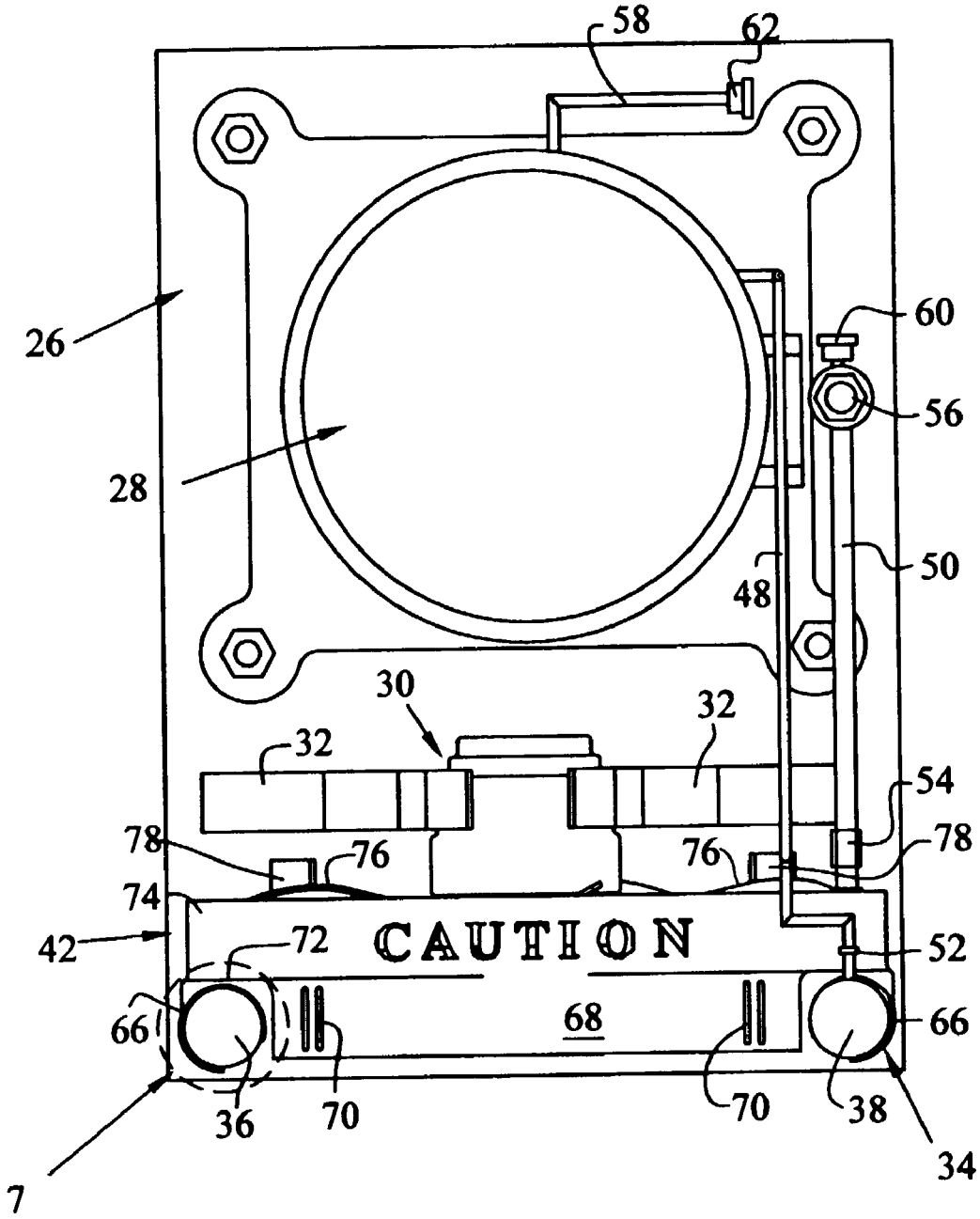
FIG. 3 is plan view of the condensing unit of FIG. 2.
Figure 4:
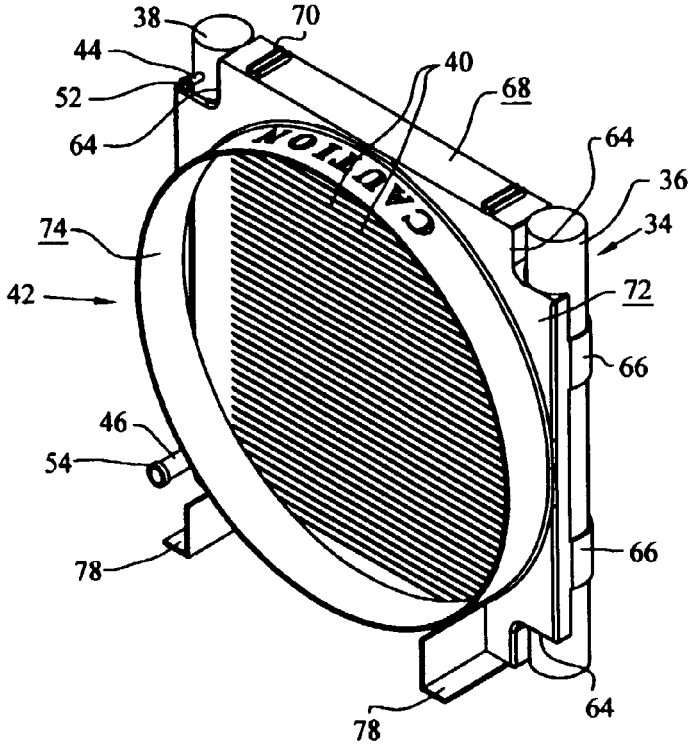
FIG. 4 is a perspective view of a fan shroud and condenser assembly in accordance with the present invention.
Figure 5:
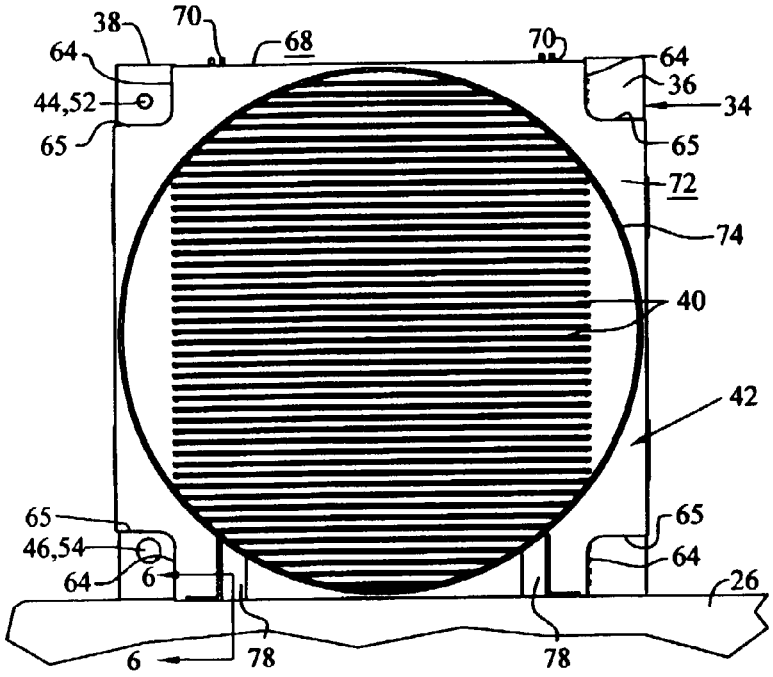
FIG. 5 is a rear view of the fan shroud and condenser assembly of FIG. 5.

A refrigerating or condensing unit including the inventive shroud is shown in FIG. 2. Condensing unit 24 is comprised of a substantially horizontal, planar base 26 to which compressor assembly 28 is affixed. Compressor assembly 28 may be a hermetic compressor assembly of any commonly known type, e.g., a scroll, a rotary, or a reciprocating piston design, each of which is well-known in the art. Condensing unit 24 further comprises fan and motor assembly 30 which is affixed via legs 32 to base 26. Because the fan and motor assembly is not attached to the inventive shroud, the shroud and/or the condenser which it mounts to the base may be removed from the base without affecting the fan and motor assembly, and vice versa.

Condensing unit 24 further comprises planar condenser 34 of known type which has a pair of cylindrical headers 36, 38 defining the condenser side edges, and heat exchange tubes 40 extending therebetween. The respective planes in which base 26 and heat exchanger 34 lie are substantially perpendicular, as shown. As described above, heat exchange tubes may be flat and provided with a plurality of microchannels through which refrigerant passes between the headers. Further, although not shown, convection fins may be conductively attached to tubes 40.

In accordance with the present invention, condenser 34 requires no brackets to be attached thereto for mounting the condenser to the condensing unit or for attaching the condenser and shroud 42. In the depicted embodiment of condenser 34, header 38 is provided near its opposite ends with inlet tube 44 and outlet tube 46, which are respectively attached to compressor discharge tube 48 and system liquid tube 50 via fittings 52 and 54. Discharge tube 48 extends from the outlet of compressor assembly 28, and provides high pressure/high temperature refrigerant gas to the condenser, wherein it is cooled and experiences a phase change to a high pressure liquid. Liquid tube 50 extends from fitting 54 to expansion device 56, through which the refrigerant experiences a phase change to a low pressure/low temperature gas which is directed to the refrigerating system evaporator (not shown). Compressor 28 is also provided with compressor suction tube 58 into which suction pressure gas is drawn for compression within the compressor. Fittings 60 and 62 are respectively provided at expansion device 56 and compressor suction tube 58, and provide a means for attaching lines in fluid communication with a known evaporator (not shown) which completes the refrigerating system of which the inventive condensing unit is a part.

Notches 64 are integrally formed in the four corners of shroud 42 and define edges 65 in the shroud which are distanced from the outer surfaces of inlet and outlet tubes 44 and 46, for providing clearance between the shroud and these tubes, but which do not allow air to recirculate through the shroud. As noted above, the inlet and outlet tubes of the heat exchanger may be located at opposite ends of a single header, or at the respectively opposite ends of the headers located on opposite edges of the heat exchanger. The inventive shroud may thus be used with various condensers adapted to fit different condensing units.

Inventive shroud 42 is provided with integral, flexible extensions or gripping portions which, as described herein below, surround and grip the outer cylindrical surfaces of headers 36 and 38 to secure condenser 34 to shroud 42, the headers being captured within the shroud gripping portions. Shroud 42 also has top surface 68 on which are integrally formed elongate tabs or bosses 70. Bosses 70 extend in the fore-aft directions and provide a stable surface by which the shroud alone, or the shroud with condenser 34 attached thereto, may be placed upside down on an assembly table without falling over.

Shroud 42 also has rear panel 72 against which headers 36 and 38 lie when the shroud and condenser are assembled. Panel 72 is provided with integrally formed, rearwardly projecting cylindrical portion 74 which forms an aperture in the shroud through which air drawn through the heat exchanger flows. Fan and motor assembly 30 includes a plurality of fan blades 76, the tips of which are in close proximity to, and are located within, cylindrical portion 74.

Shroud 42 is provided, at its bottom edge, with a pair of feet 78 by which the shroud, and thus the condenser mounted to the shroud, are attached to base 26 of condensing unit 24. The shroud alone, or the shroud with condenser 34 attached thereto, may be placed on its feet on an assembly table without falling over.

Shroud 42 may be formed by any suitable process and material such as, for example, injection molding of a high temperature plastic material which provides the requisite stability for mounting the condenser and flexibility allowing integral gripping portion 66 to resiliently bend in order to receive headers 36 and 38 of condenser 34.

Note that cylindrical portion 74 may include, embossed therein near the uppermost portion thereof, a part number or cautionary text which may be easily viewed after installation of shroud 42 to condensing unit 24.

Figure 6:
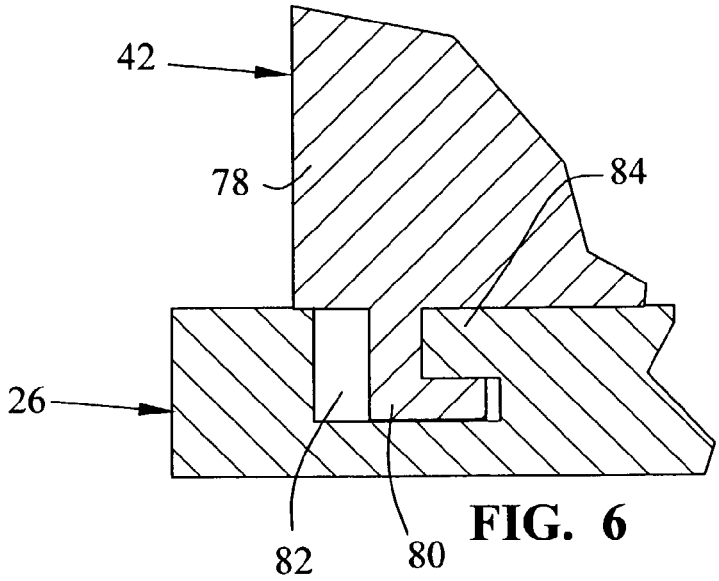
FIG. 6 is an enlarged, fragmentary sectional view taken along line 6 in FIG. 3, showing the shroud-to-base attachment.

Referring to FIG. 6, it will be understood and appreciated by those of ordinary skill in the art that shroud 42 is attached to base 26 by means of its feet 78 each being provided with an integrally formed L-shaped hook 80 which is received in a mating recess 82 provided in the base, the shroud attached to the base through feet 78 interfitting with base 26. Each recess 82 is formed with overlapping portion 84 which engages a portion of L-shaped hook 80, thereby restricting movement of the shroud relative to the base once engagement of base retaining portion 84 and the forwardly projecting portion of L-shaped hook 80. A slight interference fit exists between shroud 42 and base 26 which serves to maintain the engagement of portions 84 and hooks 80. Alternatively, as can now be readily visualized by one of ordinary skill in the art, feet 78 may be provided with a plurality of holes (not shown) through which bolts or screws (not shown) may be inserted and threaded into receiving holes (not shown) provided in base 26 for securing shroud 42 to base 26.

Figure 7:
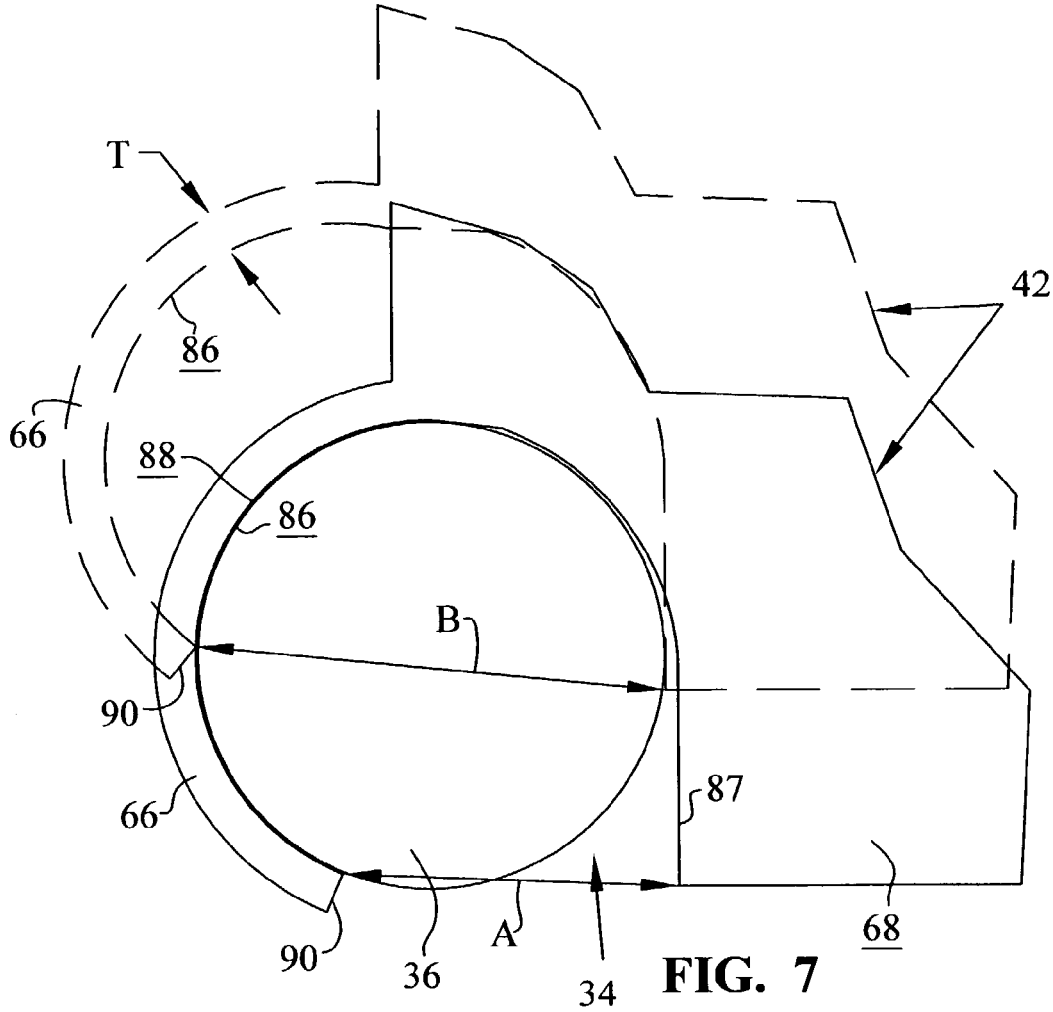
FIG. 7 is an enlarged view of the circled area of FIG. 3, showing the engagement between the inventive shroud and one of the cylindrical headers of the heat exchanger.

Referring now to FIG. 7, a substantially circular outline is defined by substantially cylindrical inner surface 86 of each gripping portion 66. In the present embodiment, as shown in FIG. 7, each gripping portion 66 includes a cantilever extending from shroud 42, the cantilever having a proximal end portion attached to shroud 42 and a distal end, represented by tip 90, free to move with respect to the proximal end portion. In its natural state, when condenser 34 is not mounted to shroud 42, gripping portions 66 each have a distance between shroud edge 87 and gripping portion tip 90 which is somewhat less than distance A shown in FIG. 7. As condenser 34 and shroud 42 are forced together, gripping portions 66 elastically deform, flexing laterally outwardly. During engagement of the shroud and condenser, tips 90 slide along outer header surfaces 88, and then the headers enter and are captured within the spaces defined by gripping portions 66, which resiliently return to substantially the condition of their free state. During installation of the heat exchanger to the shroud, gripping portions 66 flex outwardly to the extent that distance A is expanded to approximately distance B between shroud edge 87 and gripping portion tip 90, as shown in ghosted lines in FIG. 7. As the headers become seated within the spaces defined by inner surfaces 86 of gripping portions 66, the distance between each shroud edge 87 and gripping portion tip 90 contracts from distance B. At the point when the header is fully seated within the shroud, and inner surface 86 of gripping portion 66 has surface-to-surface contact with surface 88 of the header, and these cylindrical surfaces become coaxial. When the condenser is fully seated within the shroud, the distance between shroud edge 87 and gripping portion tip 90 reaches approximately distance A as shown in solid lines in FIG. 7. In this position, the gripping portions may be still slightly flexed laterally outwardly to maintain an adequate grip on the headers, thereby bracing the condenser, but approximate the shape had in their unflexed, free state. Although FIG. 7 shows only one gripping portion 66 being engaged with header 36, it is to be understood that each gripping portion 66 similarly engages its respective header. The bottommost edge of condenser 34, which may be defined by the bottommost ends of headers 36, 38, may rest on base 26, thereby allowing shroud 42 to primarily support condenser 34 against fore-aft movement, the weight of the condenser being borne by the base.

What is claimed is:

1. A refrigerating unit comprising:

a base, said base including a compressor mounted thereon;

a heat exchanger through which air passes, wherein said heat exchanger has opposite side edges; and an air-directing shroud attached to said base, wherein said shroud has a plurality of elastically deformable gripping portions, said gripping portions independently gripping said heat exchanger, each of said heat exchanger side edges being engaged with at least one of said shroud gripping portions, said heat exchanger being mounted to said base through the engagement of said heat exchanger and said shroud, said elastically deformable gripping portions each comprising a cantilever extending from said shroud, said cantilever having a proximal end portion attached to said shroud and a distal end portion free to move with respect to said proximal end portion.

2. The refrigerating unit of claim 1, wherein said gripping portions are integrally formed with said shroud.

3. The refrigerating unit of claim 1, wherein said shroud is provided with integrally formed indicia which are visible after said shroud and heat exchanger have been attached to said base.

4. The refrigeration unit of claim 1, wherein said shroud has a top surface provided with at least one elongate boss, said at least one boss providing a means for supporting said shroud when placed upside down prior to said shroud being attached to said base, wherein said shroud is supportable solely by said at least one boss when said shroud is placed upside down during assembly of said refrigerating unit.

5. The refrigerating unit of claim 4, wherein said at least one elongate boss provides a means for supporting said shroud and said heat exchanger when said shroud and said heat exchanger are engaged, and when said shroud and said heat exchanger are placed upside down prior to said shroud being attached to said base.

6. The refrigeration unit of claim 1, further including a pair of headers which define said opposite side edges, each said header being captured within at least one said gripping portion, each said header having an outer surface which is substantially cylindrical, and each said gripping portion having an inner surface which is substantially cylindrical and interfaces with a said header substantially cylindrical outer surface, respective ones of said interfacing surfaces being substantially in surface contact with each other.

7. The refrigeration unit of claim 1, further including a pair of headers which define said opposite side edges, each said header being captured within at least one said gripping portion, said headers having a cross-sectional geometry substantially inscribable within a circle, said gripping means substantially enveloping at least 180 degrees of said circle.

8. The refrigeration unit of claim 1, said base having at least one recess, said shroud having at least one projection engaging said at least one recess.

9. A refrigerating unit comprising:

a base, said base including a compressor mounted thereon;

a heat exchanger through which air passes, wherein said heat exchanger has opposite side edges;

a pair of headers which define said heat exchanger opposite side edges; and an air-directing shroud attached to said base, wherein said shroud has a plurality of gripping portions, said headers being captured within said shroud gripping portions wherein said heat exchanger is engaged with said shroud, said heat exchanger being mounted to said base through the engagement of said heat exchanger and said shroud.

10. The refrigerating unit of claim 9, wherein each said heat exchanger header has an outer surface which is substantially cylindrical, and each said shroud gripping portion has an inner surface which is substantially cylindrical and interfaces with a said header substantially cylindrical outer surface, respective ones of said interfacing surfaces being substantially in surface contact with each other.

11. The refrigerating unit of claim 10, wherein a said header outer surface and a said shroud gripping portion inner surface are substantially coaxial.

12. The refrigeration unit of claim 9, said headers having a cross-sectional geometry substantially inscribable within a circle, said gripping means enveloping at least 180 degrees of said circle.

13. A refrigerating unit comprising:

a base;

a heat exchanger through which air passes; and an air-directing shroud attached to said base, said heat exchanger being engaged with said shroud, said heat exchanger being mounted to said base through the engagement of said heat exchanger and said shroud wherein said shroud is substantially rectangular and is provided with a plurality of notched corners, and said heat exchanger has opposite side edges and is provided with one of an inlet tube and an outlet tube located near an end of a said side edge, a said notched corner providing a notched corner edge which partially surrounds said inlet or outlet tube, clearance being provided between said shroud notched corner edge and said heat exchanger inlet or outlet tube.

14. The refrigerating unit of claim 13, wherein each corner of said substantially rectangular shroud is notched, whereby a said heat exchanger inlet or outlet tube provided near either end of either of said opposite side edges is provided with clearance to said shroud.

15. The refrigerating unit of claim 13, wherein said heat exchanger opposite side edges are defined by a pair of headers about which said heat exchanger is gripped by elastically deformable portions of said shroud.

16. The refrigerating unit of claim 15, wherein said heat exchanger headers and said shroud elastically deformable portions have substantially cylindrical interfacing surfaces.

17. A condensing unit comprising:

a base;

a heat exchanger through which air passes, said heat exchanger having opposite side edges defined by a pair of substantially cylindrical headers, said heat exchanger having an inlet tube and an outlet tube, at least one of said headers having one of said inlet tube and said outlet tube extending from a side surface of said header near one end of said header; and a substantially rectangular air-directing shroud attached to said base and being provided with a plurality of notched corners, each said notched corner forming a notched corner edge, said shroud having a top surface which is provided with at least one elongate boss, said shroud having a plurality of integrally-formed resilient gripping portions which surround and capture said heat exchanger headers, whereby said heat exchanger and said shroud are engaged, wherein said heat exchanger is mounted to said base through the engagement of said heat exchanger and said shroud, clearance is provided between said shroud notched corner edge and said heat exchanger inlet or outlet tube, and said at least one boss provides a means for supporting said shroud when placed upside down prior to said shroud being attached to said base.

* * * * *